US009518406B1

(12) United States Patent
Buerger et al.

(10) Patent No.: US 9,518,406 B1
(45) Date of Patent: Dec. 13, 2016

(54) ELECTROMECHANICAL LATCH

(71) Applicant: Sandia Corporation, Albuquerque, NM (US)

(72) Inventors: Stephen Buerger, Albuquerque, NM (US); Lisa C. Marron, Albuquerque, NM (US); Michael A. Martinez, Albuquerque, NM (US); Barry Louis Spletzer, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 335 days.

(21) Appl. No.: 14/220,370

(22) Filed: Mar. 20, 2014

Related U.S. Application Data

(60) Provisional application No. 61/807,234, filed on Apr. 1, 2013.

(51) Int. Cl.
*E05C 17/56* (2006.01)
*E05B 47/02* (2006.01)

(52) U.S. Cl.
CPC ..... *E05B 47/02* (2013.01)

(58) Field of Classification Search
CPC ..... E05B 47/0012; E05B 2047/0014; E05B 2047/0017; E05B 2047/0018; E05B 2047/002; E05B 2047/0036; E05B 2047/0048–2047/0071; E05B 17/0029; E05B 81/00
USPC ..... 292/144, 201; 70/277, 278.7, 279.1, 70/280–283
See application file for complete search history.

(56) References Cited

U.S. PATENT DOCUMENTS 6,010,168 A 1/2000 Johnson
6,511,106 B2 * 1/2003 Perkins ..... E05B 81/34 292/216
6,517,127 B1 * 2/2003 Lu ..... E05B 47/0012 292/142
6,811,118 B2 * 11/2004 Collet ..... B64C 25/26 244/102 A
8,151,610 B2 * 4/2012 Fujihara ..... E05B 77/283 292/201
8,308,203 B1 * 11/2012 Spletzer ..... E05B 47/0669 292/111
8,388,030 B2 * 3/2013 Takahashi ..... E05B 81/16 292/201
8,419,083 B2 4/2013 Burmesch
(Continued)

FOREIGN PATENT DOCUMENTS

DE 10361447 * 8/2005
DE 102012011420 * 12/2013

*Primary Examiner* — Janet M Wilkens
(74) *Attorney, Agent, or Firm* — Daniel J. Jenkins

(57) ABSTRACT

An electromechanical latch is described herein. The electromechanical latch is a dual-actuator latch, wherein a first actuator and a second actuator are driven with precise timing to move a first latch part relative to a second latch part, and vice versa. When the electromechanical latch is in a closed position, the first rotary latch part is positioned to prevent rotation of the second rotary latch part in a first direction. To transition the electromechanical latch from the closed position to an open position, the first actuator drives the first rotary latch part such that the second rotary latch part is able to rotate in the first direction. Thereafter, the second actuator drives the second rotary latch part in the first direction until the electromechanical latch is in the open position.

19 Claims, 13 Drawing Sheets

(56) References Cited

U.S. PATENT DOCUMENTS

| | | | | |
|---|---|---|---|---|
| 8,646,816 | B2 * | 2/2014 | Dziurdzia | E05B 17/0029 292/201 |
| 8,757,680 | B2 * | 6/2014 | Byun | E05B 81/00 292/201 |
| 2006/0179903 | A1 | 8/2006 | Goldman | |
| 2006/0267349 | A1 * | 11/2006 | Garneau | E05B 47/0012 292/144 |
| 2007/0245784 | A1 | 10/2007 | Geringer et al. | |
| 2010/0072761 | A1 * | 3/2010 | Tomaszewski | E05B 77/26 292/201 |
| 2010/0117379 | A1 * | 5/2010 | Mitchell | E05B 77/06 292/216 |
| 2010/0257906 | A1 * | 10/2010 | Sorensen | E05B 47/068 70/91 |
| 2011/0101707 | A1 * | 5/2011 | Perkins | E05B 81/06 292/199 |
| 2011/0227351 | A1 * | 9/2011 | Grosdemouge | E05B 81/14 292/201 |
| 2013/0018505 | A1 | 1/2013 | Barrett et al. | |
| 2014/0252784 | A1 * | 9/2014 | Krueger | E05B 47/0012 292/219 |
| 2015/0021934 | A1 * | 1/2015 | Barmscheidt | E05B 77/04 292/336.3 |

* cited by examiner

ELECTROMECHANICAL LATCH

RELATED APPLICATION

This application claims priority to U.S. Provisional Patent Application No. 61/807,234, filed on Apr. 1, 2013, and entitled "ELECTROMECHANICAL LATCH," the entirety of which is incorporated herein by reference.

STATEMENT OF GOVERNMENTAL INTEREST

This invention was developed under Contract DE-AC04-94AL85000 between Sandia Corporation and the U.S. Department of Energy. The U.S. Government has certain rights in this invention.

BACKGROUND

Latches are generally employed to cause an enclosing device, such as a door to an enclosure, to be closed and securely held in the closed position. Oftentimes, such latches are relatively simple mechanical systems, wherein the latch can be manually transitioned from an open position to a closed position, with little to no security associated therewith. In some situations, however, it may be desirable to restrict access to an interior region of an enclosure unless a particular condition is satisfied. In an exemplary embodiment, a fuse box can be positioned on a factory floor and retained in an enclosure, wherein a door to the enclosure can be secured in a closed position through use of a latch. It may be desirable to restrict access to the fuse box to a certified electrician, such that the latch cannot be transitioned to an open position unless identity of the electrician is confirmed. For example, a keypad may be placed in relative close proximity to the latch, and the latch can transition to an open position responsive to the electrician setting forth a proper password through use of the keypad. A circuit associated with the keypad can transmit a signal to the latch responsive to detecting receipt of the proper password, and the latch can transition to the open position responsive to receipt of the signal.

Often, electromechanical latches, such as the type described above, require an external power source (e.g., to operate the circuit and to drive an actuator that transitions the latch to the open position). In other conventional electromechanical latches, batteries can be included therein to power internal circuitry and actuators. Utilization of a battery, however, can increase the size of an electromechanical latch, and further can increase maintenance associated with the electromechanical latch, as the battery will periodically need to be replaced.

Still further, an environment where an electromechanical latch may desirably be employed can be associated with various influences that may affect operation of the electromechanical latch. Exemplary environmental influences include electric fields, vibration, humidity, heat, etc. These influences can negatively impact operation of the electromechanical latch; for example, an electric field may result in an actuator being powered, thus transitioning the electromechanical latch to the open position despite the opening condition being unsatisfied.

SUMMARY

The following is a brief summary of subject matter that is described in greater detail herein. This summary is not intended to be limiting as to the scope of the claims.

Described herein are various technologies pertaining to an electromechanical latch. The electromechanical latch is particularly well-suited for use in environments with constraints imposed due to conditions existent in the environment. For example, the electromechanical latch can be powered based upon signals output by sensor devices, such that the electromechanical latch need not be coupled to an external power source or include a battery. The electromechanical latch described herein comprises two independent actuators (e.g., DC motors) that are configured to move two independent latch parts, with relatively precise timing, responsive to receipt of a sensor signal (or signals) that indicates occurrence of a predefined condition. The two actuators are powered (driven) at precise points in time responsive to receipt of the sensor signal, such that the latch parts are moved relative to one another to allow for opening and closing the latch. If the relative timing of operation of the two actuators is incorrect, or if only one of the latch parts of the two independent latch parts is moved, the latch will not transition from the closed position to the open position. Such configuration can mitigate susceptibility of the latch to inadvertent transitioning from the closed position to the open position in response to stray electrical currents in the latch or its surrounding environment.

When the electromechanical latch is in the open position, the electromechanical latch can be held in the open position without requiring the actuators to be powered. Additionally, when held in the open position, an output stage of the electromechanical latch can be rotated without power needing to be provided to the actuators. Additionally, the electromechanical latch can be transitioned from the open position to the closed position responsive to the output stage being subjected to an externally applied force. Thus, again, the actuators need not be powered when transitioning the electromechanical latch from the open position to the closed position. Once the electromechanical latch has returned to the closed position, the electromechanical latch may not be opened unless the two actuators are driven with the precise timing, as noted above.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
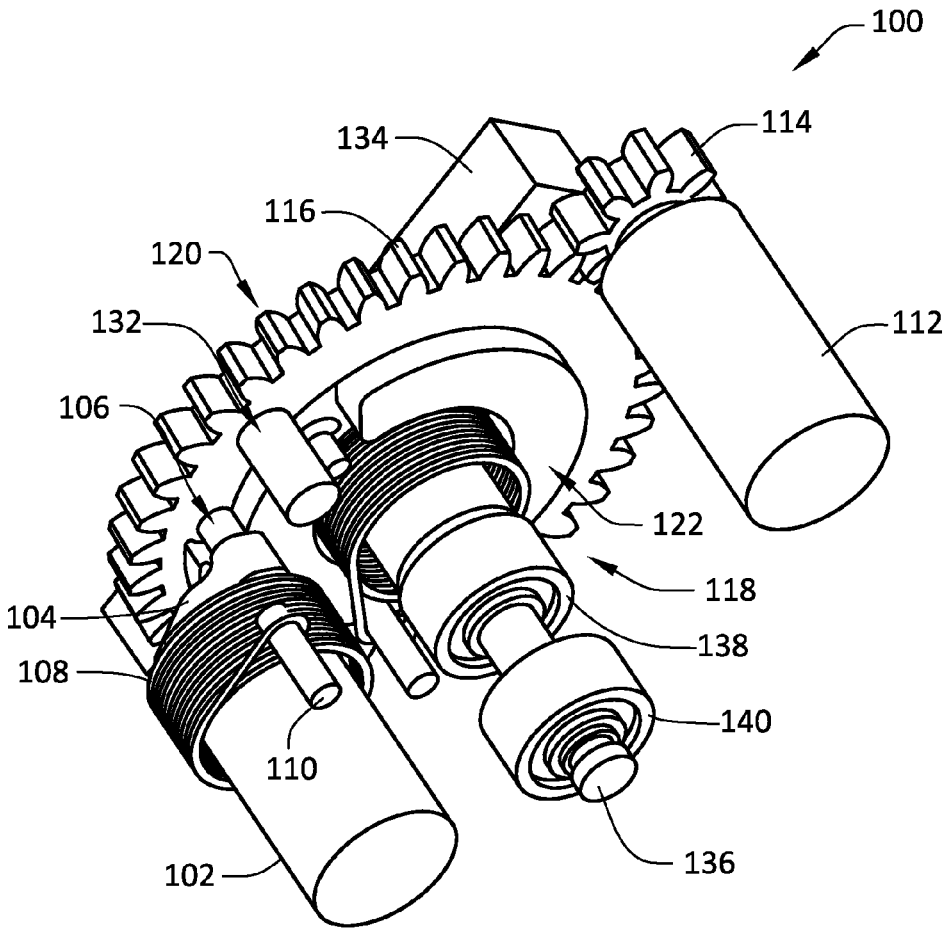
FIG. 1 is an isometric view of an exemplary electromechanical latch.

Various technologies pertaining to an exemplary electromechanical latch are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something, and is not intended to indicate a preference.

Described herein are various technologies pertaining to an electromechanical latch. An exemplary electromechanical latch described herein is particularly well-suited for utilization in environments that have influences that impose constraints in the electromechanical latch. For example, the exemplary electromechanical latch is particularly well-suited for utilization in environments where the latch may not be coupled to an external source of power, for utilization in environments where it is desired that the electromechanical latch be free of a battery, in environments associated with electric or magnetic fields, humidity, vibration, temperature fluctuations, or other conditions. As will be described herein, the exemplary electromechanical latch is a dual-actuated latch, in that two separate actuators (DC motors) drive two independent latch parts (with precise timing) to cause the latch to transition from the closed position to the open position. If the timing of the operation of the motors is incorrect, the actuators are not provided with correct power levels, or only one latch part is moved, the electromechanical latch fails to transition from the closed position to the open position. Once the electromechanical latch is in the open position, however, the electromechanical latch can remain in the open position for an indefinite amount of time, without requiring electrical power. Additionally, the electromechanical latch can be transitioned from the open position to the closed position by external forces, such that the actuators need not be powered during such transition.

Figure 2:
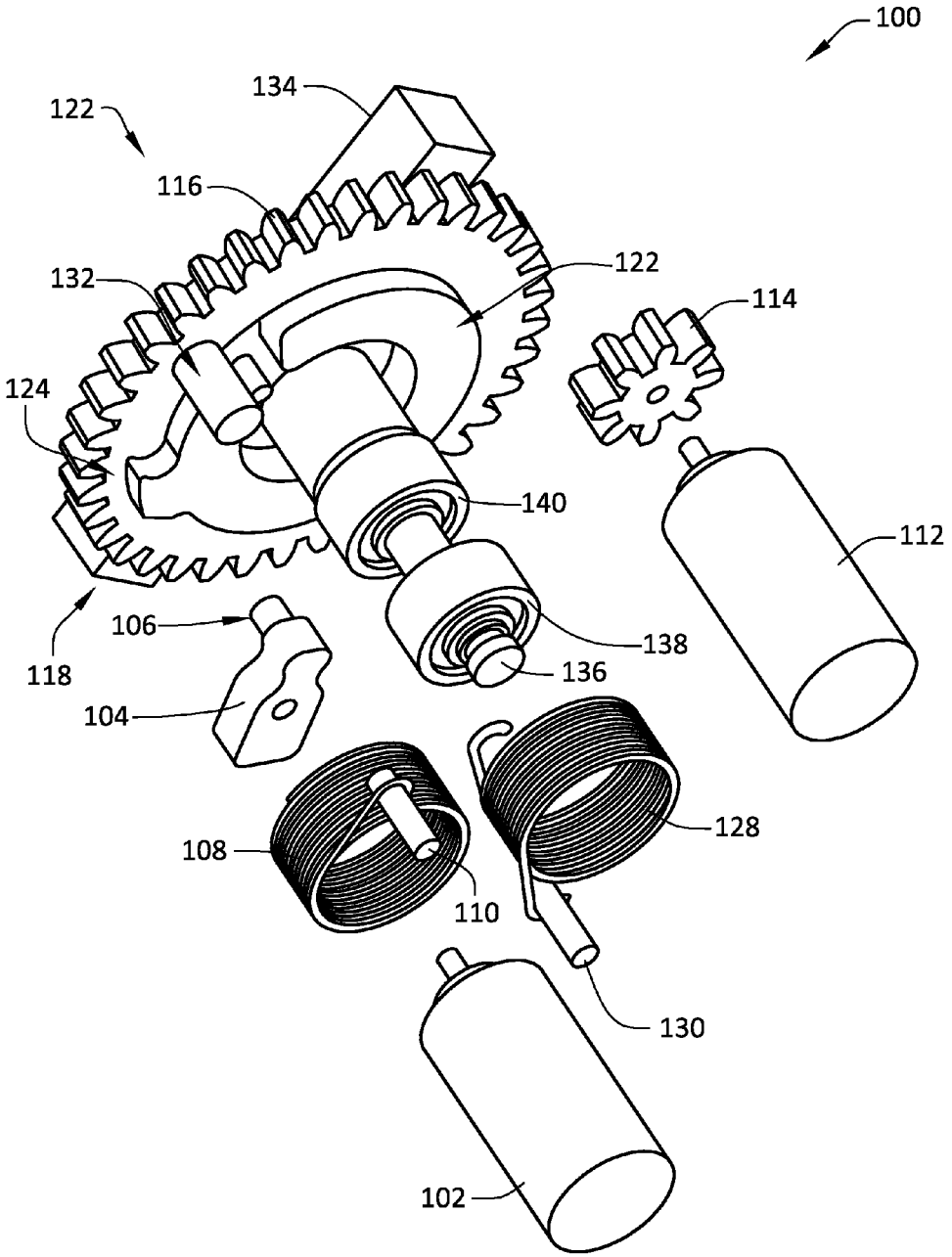
FIG. 2 is an exploded view of the exemplary electromechanical latch.
Figure 3:
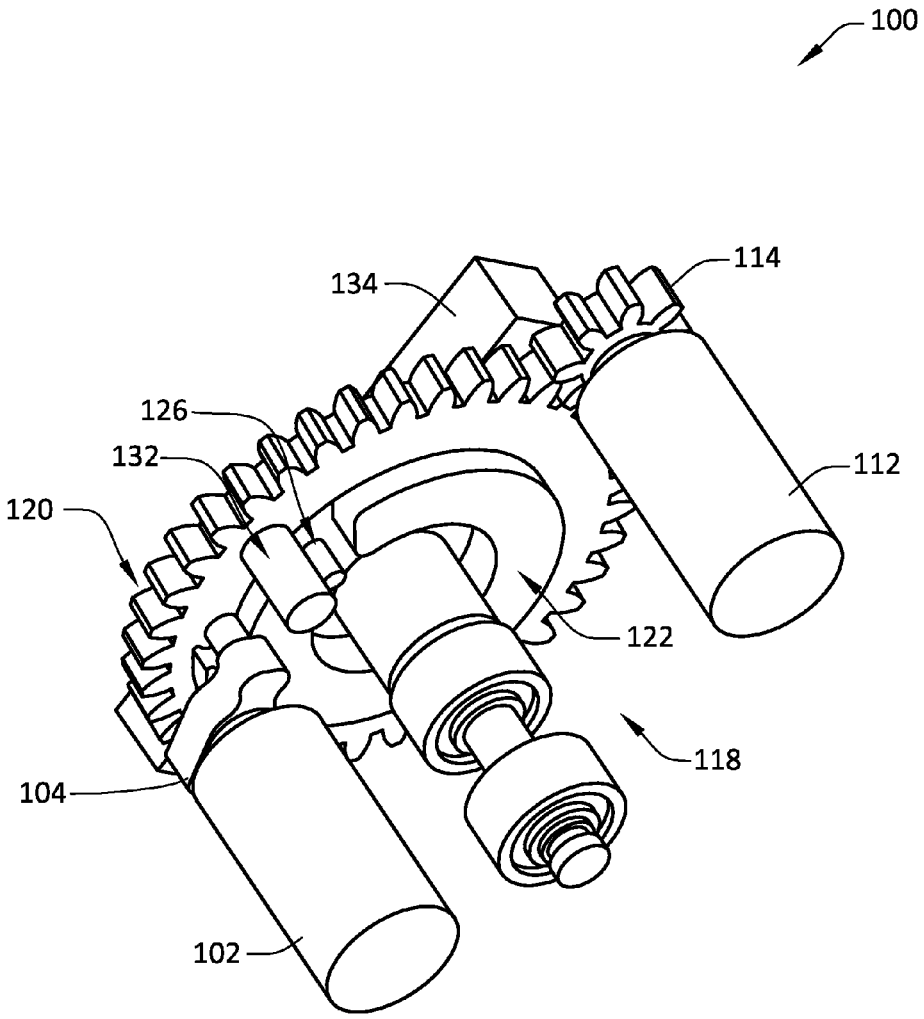
FIG. 3 is an isometric view of portions of the electromechanical latch.

With reference to FIG. 1, an isometric view of an exemplary electromechanical latch 100 is illustrated. FIG. 2 depicts an exploded view of the electromechanical latch 100, and FIG. 3 illustrates an isometric view of the electromechanical latch 100 with springs and pegs removed therefrom. Referring concurrently to FIGS. 1-3, the electromechanical latch 100 comprises a first actuator 102, which, in an exemplary embodiment, may be a first DC motor. A first rotary latch part 104 is driven by the first actuator 102, wherein the first rotary latch part 104 includes a peg 106 that extends therefrom. In an exemplary embodiment, the first rotary latch part 104 can be balanced about its rotary axis to minimize or prevent movement in the presence of vibration.

The first actuator 102 is configured to rotate the first rotary latch part 104 in a first direction. The electromechanical latch 100 further comprises a first spring 108 that is coupled to the first rotary latch part 104, wherein the first spring 108 applies a bias torque that opposes rotation of the first rotary latch part 104 in the first direction. As shown, in an exemplary embodiment, the first spring 108 may be a coiled torsion spring, wherein the coiled torsion spring is positioned over at least a portion of the first actuator 102 and at least a portion of the first rotary latch part 104. In addition, the first spring 108 can be coupled to a first stationary peg 110, wherein the first stationary peg 110 can be a portion of a housing (not shown) that houses the electromechanical latch 100. Coupling of the first spring 108 to the first stationary peg 110 prevents the first spring 108 from rotating when the first actuator 102 drives the first rotary latch part 104, and causes the first spring 108 to exert a torque on the first rotary latch part 104.

The electromechanical latch 100 further includes a second actuator 112, wherein the second actuator 112 may be a second DC motor. A drive pinion 114 is driven by the second actuator 112. The electromechanical latch 100 further comprises a second rotary latch part 116 that is driven by the second actuator 112 by way of the drive pinion 114. The second rotary latch part 116 can be balanced about its rotary axis to minimize or prevent movement in the presence of vibration. The second rotary latch part 116 comprises a plurality of teeth, wherein teeth of the second rotary latch part 116 mate with teeth of the drive pinion 114. The second rotary latch part 116 has a proximal side 118 and a distal side 120. The proximal side 118 of the second rotary latch part includes a raised cam 122. The raised cam 122 includes a detent 124, wherein the detent 124 comprises a closed detent (formed as a hooked mating region) and an open detent (formed as a ramped mating region). The raised cam 122 further comprises a recess, and a peg 126 that extends from the proximal side 118 of the second rotary latch part 116 is positioned in such recess. A second spring 128 is coupled to the peg 126 on the second rotary latch part 116 and a second stationary peg 130, wherein the second spring 128 applies a bias torque in a direction that opposes the direction of the second rotary latch part 116 when driven by the second actuator 112. In an exemplary embodiment, the second spring 128 can be a coiled torsion spring. It can be ascertained that a force exerted by the second actuator 112 must exceed the bias torque applied on the second rotary latch part 116 by the spring for the second rotary latch part 116 to rotate. The second stationary peg 130, like the first stationary peg 110, may be a portion of a housing that houses the electromechanical latch 100.

A stop peg 132 extends from the proximal side 118 of the electromechanical latch 100. As will be described in greater detail below, the stop peg 132 can be configured to contact a mechanical stop of the housing when rotated in either direction. The distal side 120 of the electromechanical latch 100 includes an output stage 134 that rotates with the second rotary latch part 116. In an example, the output stage 134 can act as an engagement mechanism that engages a latch bar when the electromechanical latch 100 is in the open position, and disengages the latch bar when the electromechanical latch 100 is in the closed position. Thus, when the electromechanical latch 100 is in the open position, the output stage 134 can engage a latch bar, and the latch bar can be moved (e.g., to a position where a door to an enclosure can be opened). When the door is closed and the latch bar is repositioned to hold the door in place, the output stage 134 can disengage the latch bar.

The electromechanical latch 100 also includes a shaft 136, about which the second rotary latch part 116 can rotate. Bearings 138 and 140 can be positioned on the shaft 136. Generally, the electromechanical latch 100 is transitioned from the closed position to the open position when the shaft 136 (and thus the second rotary latch part 116) is rotated in a clockwise direction (when the second rotary latch part 116 is viewed from the proximal side 118) from a fixed point. As will be shown and described in greater detail below, however, the peg 106 extending from the first rotary latch part 104 prevents the second rotary latch part 116 from rotating in the clockwise direction unless the peg 106 is clear of the closed detent of the raised cam 122.

With more particularity, the first actuator 102 and the second actuator 112 can operate with precise timing, responsive to receipt of a sensor signal or signals, to cause the electromechanical latch 100 to transition from the closed position to the open position. Such transition occurs by moving the peg 106 of the first rotary latch part 104 such that the peg 106 is clear of the closed detent, and rotating the second rotary latch part 116 to allow the peg 106 to rest on the open detent of the raised cam 122. For example, initially, the first rotary latch part 104 can be positioned such that the peg 106 is in the hooked mating region (the closed detent), thus preventing rotation of the second rotary latch part 116 in the clockwise direction. Thus, if the second rotary latch part 116 begins to rotate in a first direction (the direction required to open the latch 100) before the first rotary latch part 104 is caused to rotate to clear the closed detent, then the forces between the first rotary latch part 104 and the second rotary latch part 116 prevent the first rotary latch part 104 from moving (thus keeping the latch 100 in the closed position).

When, for example, a sensor signal is received that indicates that the electromechanical latch 100 is to transition from the closed position to the open position, the first actuator 102 can rotate the first rotary latch part 104 (against the bias torque set forth by the first spring 108), thereby rotating the peg 106 out of the hooked mating region (closed detent) of the detent 124. When the peg 106 is positioned to be clear of the closed detent, the second actuator 112 is powered, thus causing the second actuator 112 to drive the drive pinion 114 in a counterclockwise direction and the second rotary latch part 116 in the clockwise direction. A threshold amount of time after the first actuator 102 is initially provided with electrical power, power is ceased to be provided to the first actuator 102. The bias torque applied to the first rotary latch part 104 by the first spring 108 causes the first rotary latch part 104 to rotate in the clockwise direction, such that peg 106 rests against an exterior of the raised cam 122. A threshold amount of time after the second actuator 112 is initially provided with electrical power (e.g., after the second actuator has rotated the second rotary latch part 116 such that the peg 106 clears the detent 124), power is ceased to be provided to the second actuator 112. The bias torque applied to the second rotary latch part 116 by the second spring 128 causes the second rotary latch part to rotate in the counterclockwise direction until the peg 106 impacts the ramped mating region (the open detent) of the raised cam 122. At such point, the electromechanical latch 100 can remain in the open position until an external force is applied to the output stage 134. When in the open position, the electromechanical latch 100 allows for opening and/or closing of a door or enclosure (the latching or unlatching of such door).

In an exemplary embodiment, the electromechanical latch 100 is designed such that the actions of the first actuator 102 and the second actuator 112 must be timed in a relatively precise manner. For instance, the first actuator 102 may be powered to move the peg 106 from the closed detent for a relatively short period of time, such as on the order of milliseconds (e.g., 5-15 milliseconds). If the second actuator 112 fails to drive the second rotary latch part 116 in the relatively short amount of time that the peg 106 is moved from the closed detent, then the bias torque applied to the second rotary latch part 104 by the first spring 108 causes the peg 106 to return to the closed detent of the raised cam 122 (and the latch 100 will remain in the closed position). Similarly, when the second actuator 112 is powered prior to the first actuator 102 being powered, the peg 106 in the closed detent prevents the second rotary latch part 116 from rotating in the clockwise direction.

As will be described below, the electromechanical latch 100 includes circuitry that is configured to harvest energy from a plurality of different sources, such as sensors that are in communication with the electromechanical latch 100. For example, such circuitry can receive sensor signals and utilize such sensor signals as a power source for driving the first actuator 102 and/or the second actuator 112. The circuitry additionally includes timing circuitry that causes electrical power to be provided to the actuators 102 and/or 112 at precise times, thereby allowing for the electromechanical latch 100 to transition from the closed position to the open position.

Figure 4:
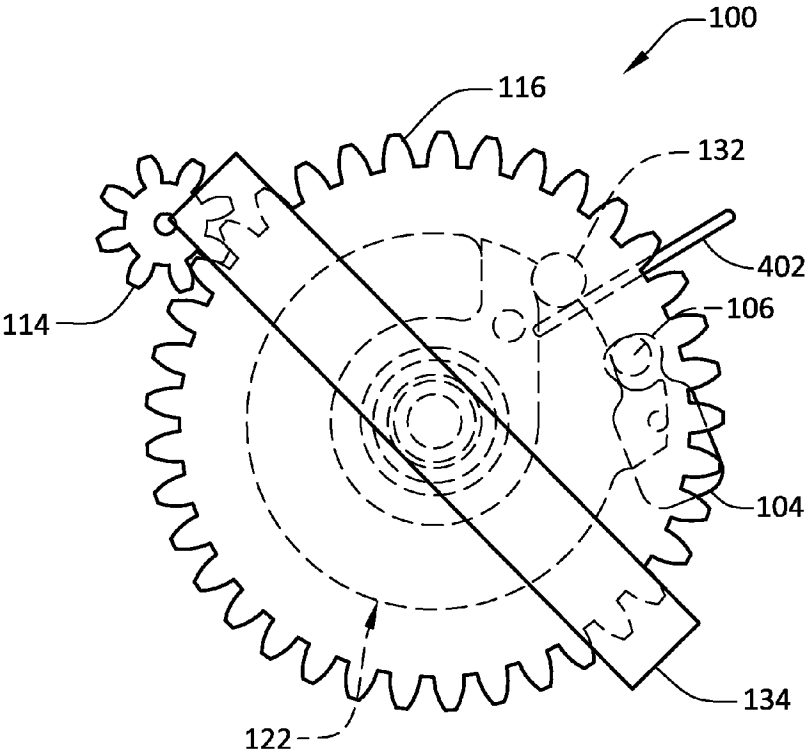

With reference now to FIGS. 4-8, transparent views of the electromechanical latch 100 (when viewed from the distal side 120) when transitioning from the closed position to the open position is illustrated. When viewed from the distal side 120, the second rotary latch part 116 must be rotated in the counterclockwise direction some threshold distance to transition from the closed position to the open position. As shown in FIG. 4, when the electromechanical latch 100 is in the closed position, the peg 106 of the first rotary latch part 104 is in the closed detent of the raised cam 122. In other words, the peg 106 rests in the hook-shaped mating region of the raised cam 122. Accordingly, the second rotary latch part 116 is unable to rotate in the counterclockwise direction. Further, a mechanical stop 402 in the housing of the electromechanical latch 100 is positioned relative to the peg 132 such that rotation of the second rotary latch part 116 in the clockwise direction, when the electromechanical latch 100 is in the closed position, is prevented.

Figure 5:
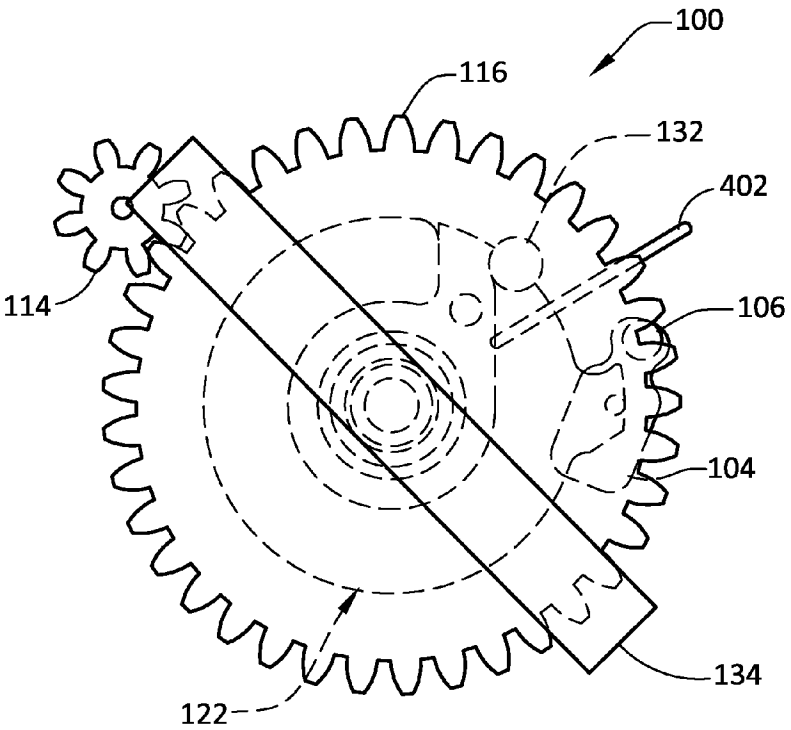
FIGS. 4-8 illustrate transition of the exemplary electromechanical latch from the closed position to the open position.

Referring now to FIG. 5, rotation of the first rotary latch part 104 such that the peg 106 is removed from the closed detent is illustrated. At least one sensor signal is received that indicates that electromechanical latch 100 is to be transitioned from the closed position to the open position.

Responsive to receipt of the at least one sensor signal, the first actuator 102 is caused to rotate the first rotary latch part 104 in a clockwise direction, thus removing the peg 106 from the closed detent of the raised cam 122. As indicated above, the first spring 108 asserts a bias torque against such rotation; thus, for example, if an electric field in the environment causes power to inadvertently be provided to the first actuator 102 such that the first rotary latch part 104 is rotated and the peg 106 is removed from the closed detent, the bias torque of the first spring 108 causes the peg 106 to return to the closed detent immediately upon the first actuator 102 ceasing to drive the first rotary latch part 104.

Figure 6:
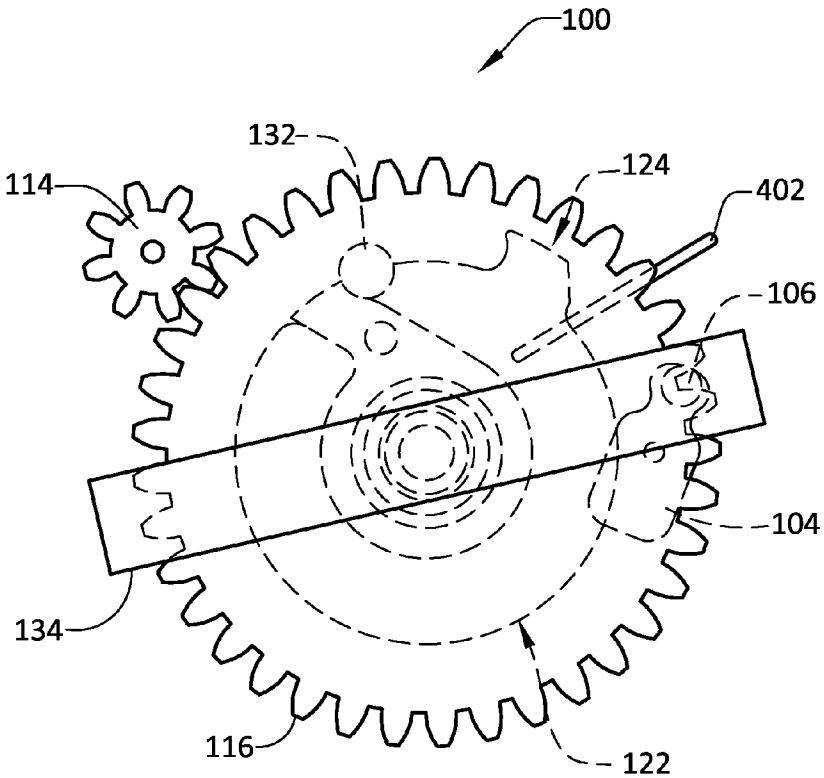

Now referring to FIG. 6, as the first actuator 102 causes the peg 106 of the first rotary latch part 104 to be clear of the detent 124 of the raised cam 122, the second actuator 112 is powered, thereby rotating the drive pinion 114, which in turn causes the second rotary latch part 116 to rotate in the counterclockwise direction. It can be ascertained that rotation of the second rotary latch part 116 causes the peg 106 to be positioned on an opposite side of the detent 124 as when the electromechanical latch 100 is in the closed position.

Figure 7:
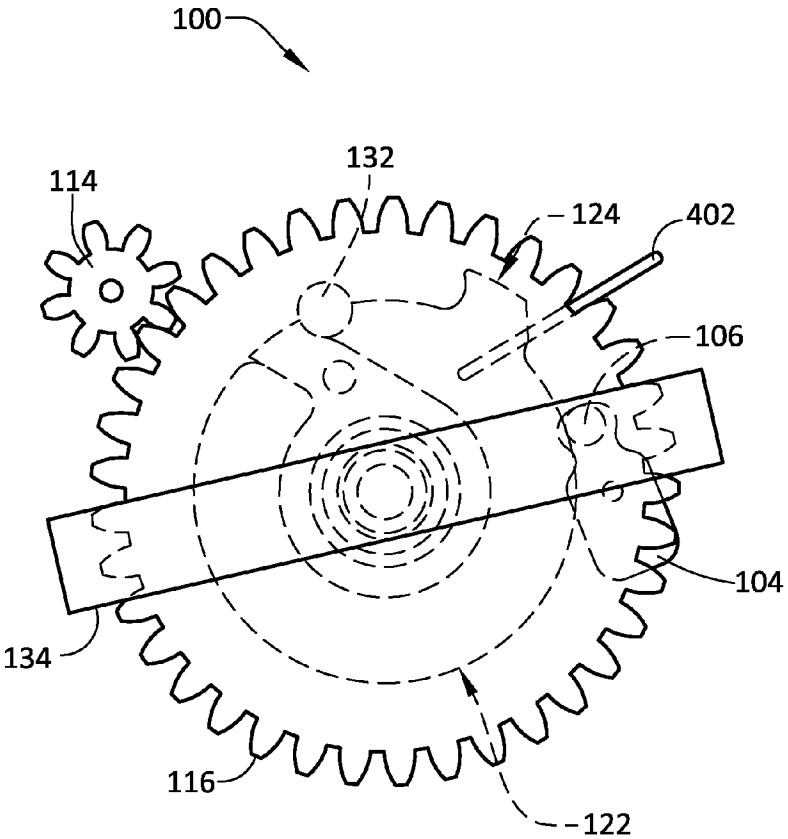

With reference now to FIG. 7, subsequent to the second rotary latch part 116 being driven in the counterclockwise direction, such that the peg 106 of the first rotary latch part 104 clears the detent 124, power is ceased to be provided to the first actuator 102. The bias torque exerted on the first rotary latch part 104 by the first spring 108 causes the first rotary latch part 104 to rotate in the counterclockwise direction, such that the peg 106 rests against the exterior of the raised cam 122.

Figure 8:
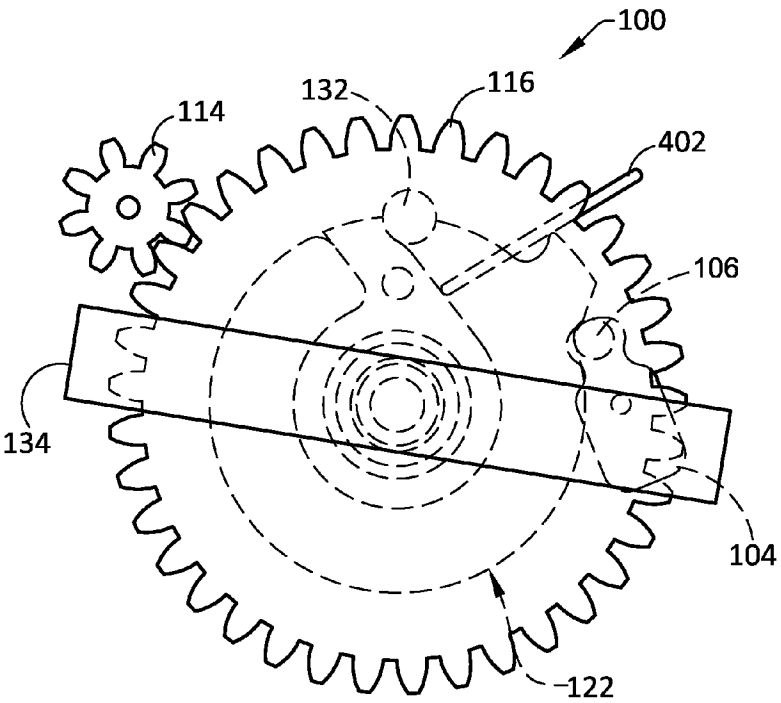

Turning to FIG. 8, power is ceased to be provided to the second actuator 112. The bias torque exerted on the second rotary latch part 116 by the second spring 128 causes the second rotary latch part 116 to rotate in the clockwise direction until the peg 106 of the first rotary latch part 104 rests against the open detent (the ramped mating region) of the raised cam 122. When the first rotary latch part 104 and the second rotary latch part 116 are in the position shown in FIG. 8, the electromechanical latch 100 is in the open position and can remain in the open position until an external force is applied to the second rotary latch part 116 (e.g., by way of the output stage 134). Additionally, power need not be provided to the first actuator 102 or the second actuator 112 to cause the electromechanical latch 100 to remain in the open position.

Figure 9:
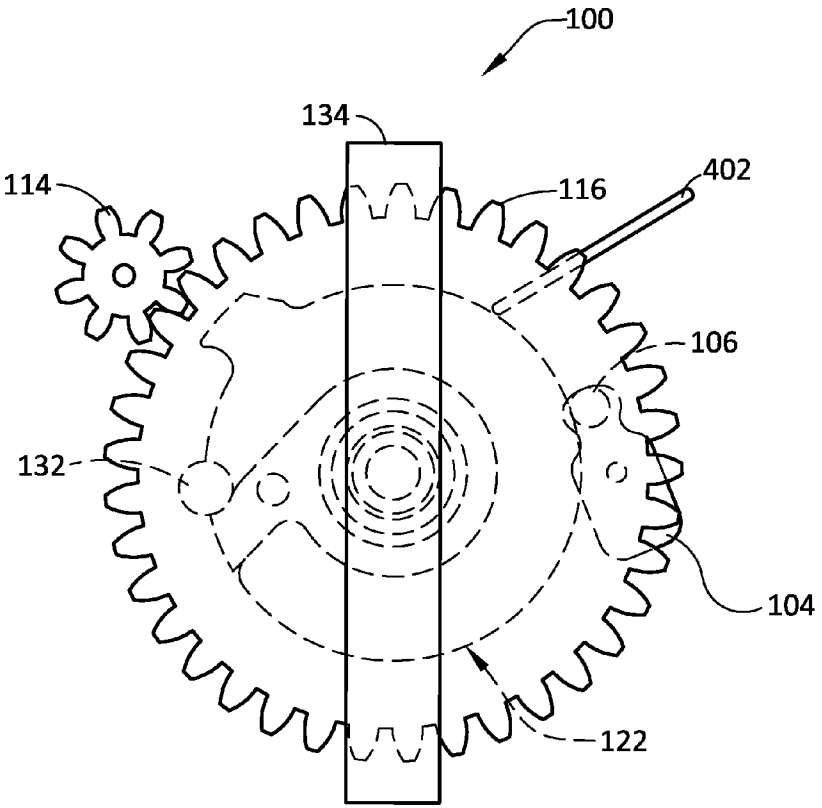
FIG. 9 illustrates operation of the exemplary electromechanical latch when in the open position.

Referring to FIG. 9, when the electromechanical latch 100 is in the open position, the second rotary latch part 116 can be rotated in a counterclockwise direction by way of an external force applied to the output stage 134. While such rotating occurs, the peg 106 of the first rotary latch part 104 remains pressed against the exterior of the raised cam 122. As noted above, in an exemplary embodiment, when the electromechanical latch 100 is in the open position, the output stage 134 can engage a latch bar, such that the latch bar can be moved to allow for opening a door of an enclosure. In an exemplary embodiment, the second rotary latch part 116 can be rotated in the counterclockwise direction until the peg 132 impacts the mechanical stop. Therefore, the electromechanical latch 100 cannot be returned to the closed position by rotating the second rotary latch part 116 360°.

Figure 11:
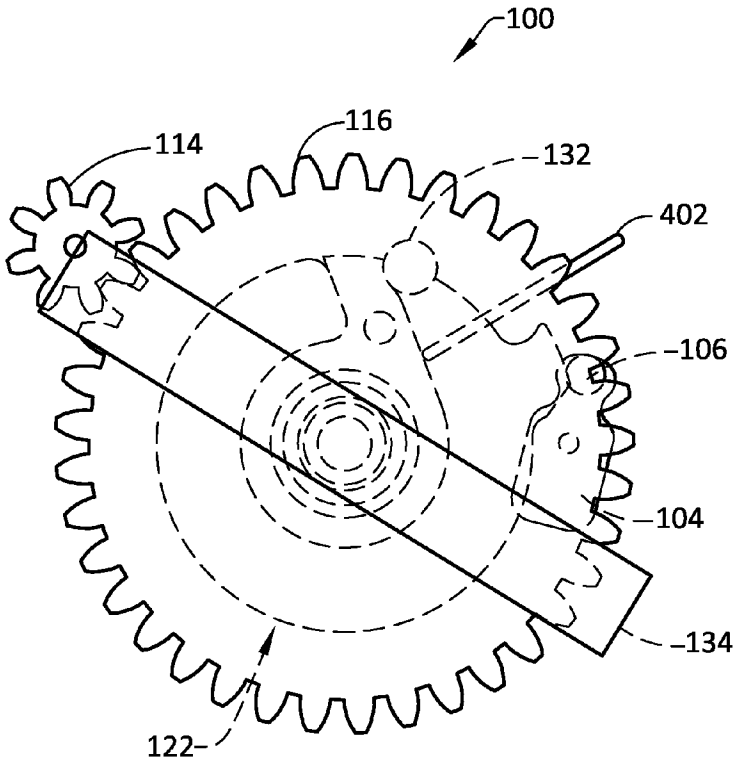
FIGS. 10-12 illustrate transition of the exemplary electromechanical latch from the open position to the closed position.
Figure 10:
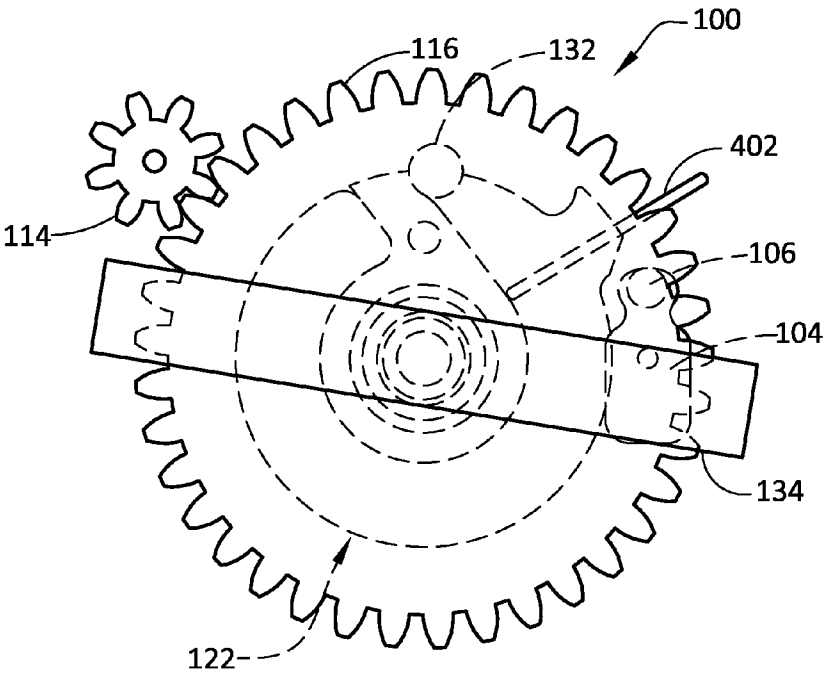
Figure 12:
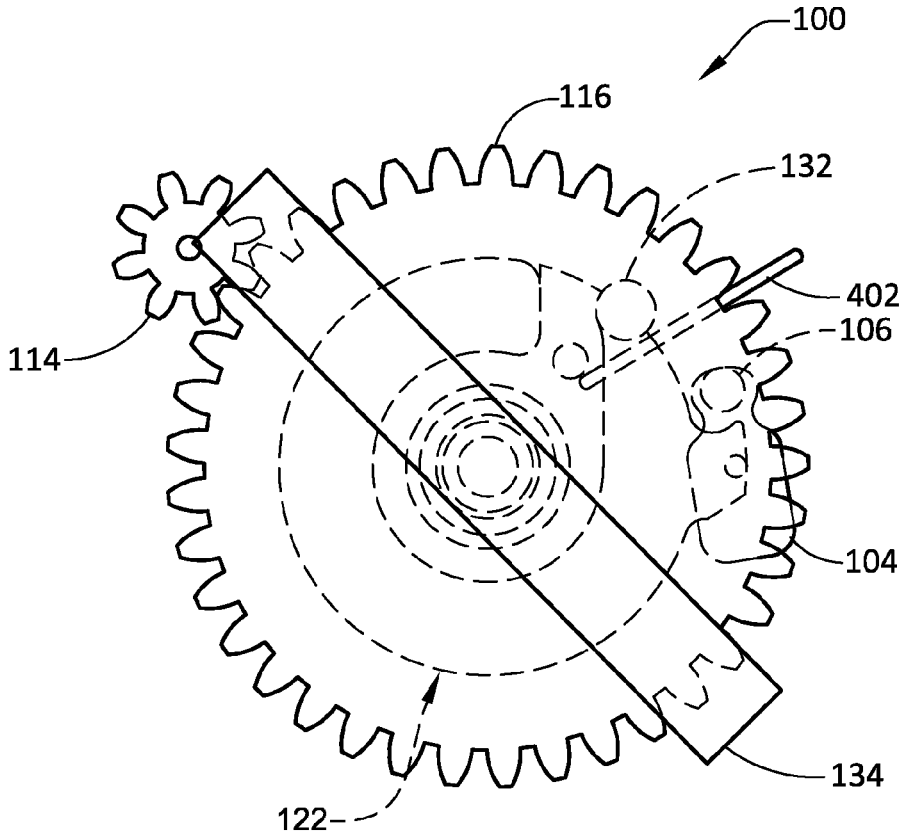

Referring collectively to FIGS. 10-12, transitioning of the electromechanical latch 100 from the open position to the closed position is illustrated. Referring solely to FIG. 10, an external force is applied to the output stage 134, such that the second rotary latch part 116 begins to rotate in the clockwise direction. As the second rotary latch part 116 rotates, the peg 106 of the first rotary latch part 104 slides up the ramped mating region of the detent 124. With reference to FIG. 11, external force is further applied to the output stage 134 until the peg 106 of the first rotary latch part 104 clears the ramped mating portion of the detent 124. FIG. 12 illustrates the electromechanical latch 100 returned to the closed position after the peg 106 has cleared the detent 124 and returned to the hooked mating portion of the raised cam 122. Specifically, as the peg 106 clears the detent, the bias torque exerted by the first spring 108 on the first rotary latch part 104 causes the peg 106 to be positioned in the closed detent.

It can be ascertained that FIGS. 1-12 illustrate a particular embodiment of the exemplary electromechanical latch 100. It is to be understood that other embodiments are also contemplated. For example, the electromechanical latch 100 may include an idler gear or a plurality of idler gears, which can be arranged to require the first latching part 104 and the second latching part 116 to rotate in the same direction or different directions. Moreover, idler gears can be included in the electromechanical latch 100 to allow output shafts of the first actuator 102 and the second actuator 112 to rotate in the same or opposite directions. Furthermore, the elements of the electromechanical latch 100 may be composed of a variety of different materials. Such materials can include metals, plastics, etc., and can be selected based upon an environment in which the electromechanical latch 100 is to be employed.

Figure 13:
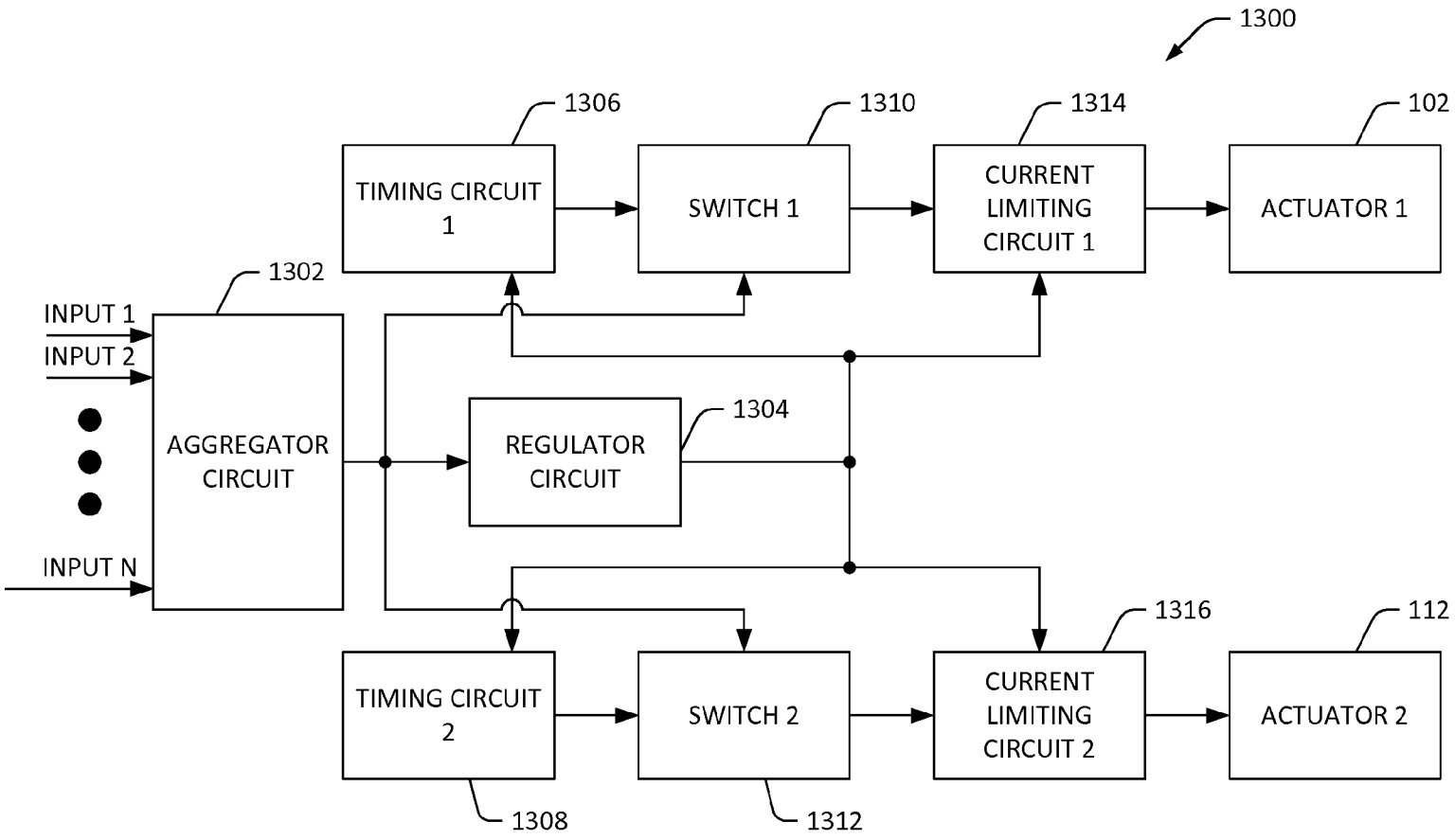
FIG. 13 is a schematic diagram of an exemplary control circuit that controls transition of the exemplary electromechanical latch from the closed position to the open position.

With reference now to FIG. 13, an exemplary control circuit 1300 that can be employed in connection with controlling operation of the first actuator 102 and the second actuator 112 is illustrated. The electromechanical latch 100 is configured to transition from the closed position to the open position responsive to receipt of a particular control signal or series of control signals. For instance, the control signal comprises at least one electrical pulse received on one or more signal input lines (e.g., lines 1-N). Such pulse(s) can serve as a power source for the electromechanical latch 100 in addition to the control signal. Due to operational and environmental variability, however, power levels (amplitudes) of such pulses may vary by a relatively large percentage (e.g., 50% or more) in normal operation of the electromechanical latch 100. The control circuit 1300 is configured to apply correct amounts of power to the actuators 102 and 112 at respective correct start and end times, such that the electromechanical latch 100 operates correctly despite potential existence of significant input power variability.

The control circuit 1300 includes an aggregator circuit 1302, which can receive a plurality of electrical pulses (control signals) from a respective plurality of input lines. Transition of the electromechanical latch 100 from the closed position to the open position, in an exemplary embodiment, is to occur responsive to receipt of at least one of such control signals. The aggregator circuit 1302 is configured to aggregate the electrical signals and output a single continuous power signal that, for example, can be high when any of the pulses in the input lines is high. The control circuit 1300 additionally includes a regulator circuit 1304 that regulates the power signal received from the aggregator circuit 1302. Accordingly, the output of the regulator circuit 1304 is a regulated signal.

The control circuit 1300 further includes a first timing circuit 1306 and a second timing circuit 1308. Responsive to receiving the regulated signal from the regulator circuit 1304 (indicating receipt of a control signal), the first timing circuit 1306 outputs a first timing pulse, wherein the first timing pulse has a first start time and a first end time. The first actuator 102 desirably drives the first rotary latch part 104 beginning at the first start time and ending at the first end time. Thus, duration of the first timing pulse output by the timing circuit 1306 corresponds to the duration of the first actuator 102 driving the first latch part 104. The second timing circuit 1308 outputs a second timing pulse responsive to receiving the regulated signal from the regulator circuit 1304. The second timing pulse has a start time and an end time, wherein the second actuator 112 desirably drives the second rotary latch part 112 beginning at the second start time and ending at the second end time. It can be ascertained that the second start time is subsequent to the first start time and prior to the first end time.

The control circuit 1300 additionally includes a first switch 1310 and a second switch 1312. The first and second switches 1310 and 1312 may be semiconductor switches, such as MOSFETs, JFETs, etc. The first timing pulse output by the first timing circuit 1306 can be received at a gate of the first switch 1310, while the combined power signal output by the aggregator circuit 1302 is provided to the source of the first switch 1310. Accordingly, output of the first switch 1310 is a first current pulse that corresponds to the first timing pulse output by the first timing circuit 1306, and having an amplitude corresponding to the combined power signal output by the aggregator circuit 1302. Similarly, the second switch 1312 receives, at its gate, the second timing pulse output by the second timing circuit 1308, while the combined power signal output by the aggregator circuit 1302 is received at the source of the second switch 1312. The output of the second switch 1312 is thus a second current pulse that corresponds to the second timing pulse output by the second timing circuit 1308, and having an amplitude corresponding to the combined power signal output by the aggregator circuit 1302.

The control circuit 1300 further comprises a first current limiting circuit 1314 and a second current limiting circuit 1316. The first current limiting circuit 1314 and the second current limiting circuit 1314 can be powered by the output of the regulator circuit 1304. The first current limiting circuit 1314 receives the first current pulse output by the first switch 1310. The first current limiting circuit 1314 outputs a first current-limited signal (with the first start time and the first end time) based upon the first current pulse. The first current-limited signal is received by the first actuator 102, which rotates the first rotary latch part 104 responsive to receiving the first current-limited signal.

The second current limiting circuit 1316 receives the second current pulse output by the second switch 1312. The second current limiting circuit 1316 outputs a second current-limited signal (with the second start time and the second end time) based upon the second current pulse. The second current-limited signal is received by the second actuator 112, which rotates the second rotary latch part 116 responsive to receiving the second current-limited signal.

It thus can be ascertained that the control circuit 1300 independently controls the timing and amplitude of current signals provided to the first actuator 102 and the second actuator 112 when transitioning the electromechanical latch 100 from the closed position to the open position. By setting both power and time, the control circuit 1300 controls total energy input to the actuators 102 and 112 over the operating time of the electromechanical latch 100.

Additionally, other embodiments of the control circuit 1300 are also contemplated. As noted above, the timing circuits 1306 and 1308 are used to output a signal that indicates when the switches 1310 and 1312 are respectively to be turned on and off. Operation of the timing circuit 1306 and 1308 can be indexed based upon a rise time of a first control signal received by the aggregator circuit 1302 or to rises of other input pulses or combinations thereof. Accordingly, while not shown, at least one of the input lines depicted as being connected to the aggregator circuit 1302 may be directly connected to at least one of the first timing circuit 1306 or the second timing circuit 1308. Additionally, more than one timing circuit can be used to time the start and/or end of an actuator power signal from the rise of one or more control signals. Furthermore, sub-circuits in the control circuit 1300 can be arranged differently to provide the actuators 102 and 112 with properly timed power signals.

Figure 14:
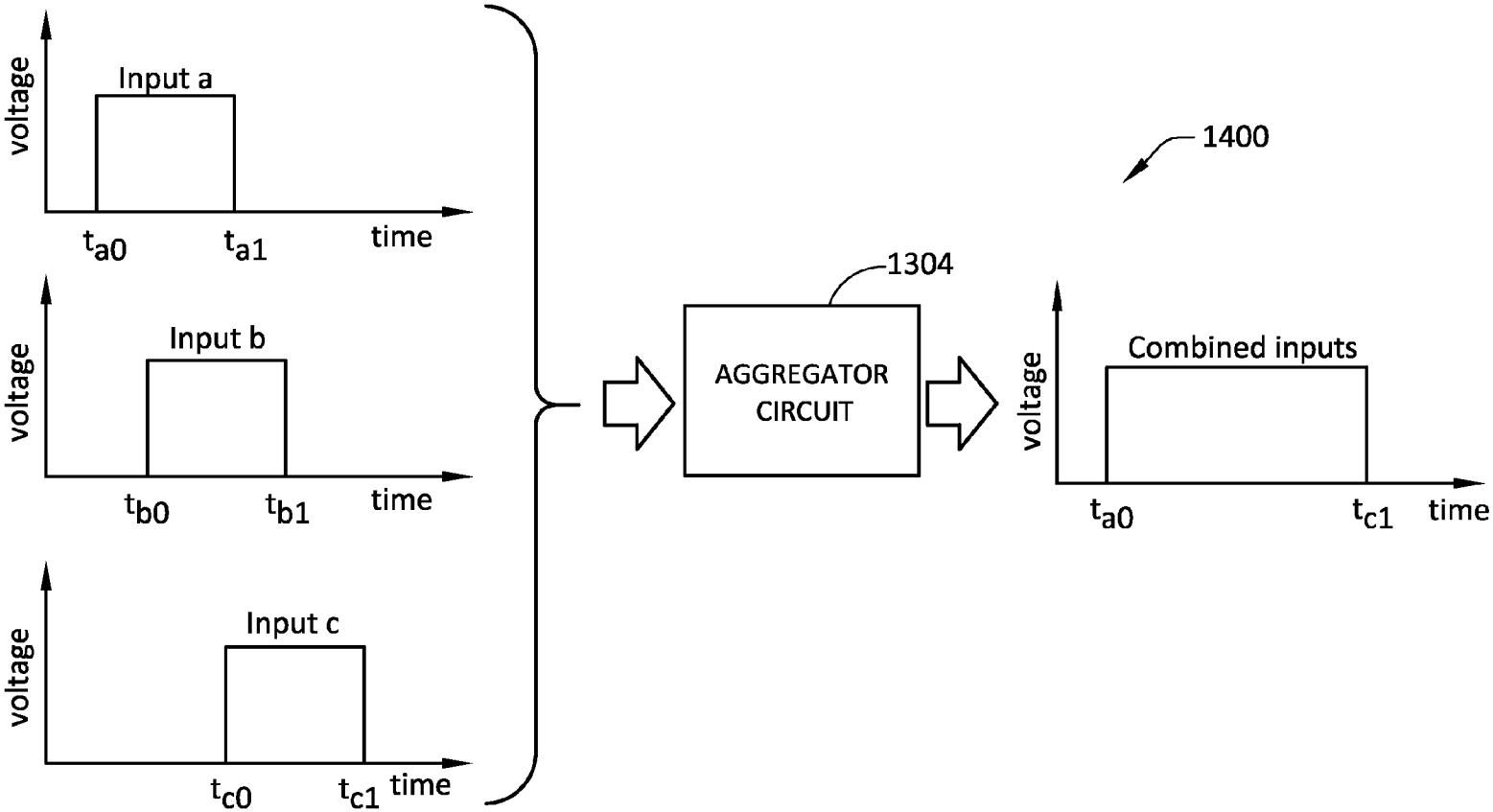
FIG. 14 illustrates operation of an exemplary aggregator circuit included in the exemplary control circuit.

Referring now to FIG. 14, a diagram 1400 illustrating exemplary operation of the aggregator circuit 1304 is illustrated. In the example shown in FIG. 14, the aggregator circuit 1304 receives a first input pulse from a first input line that rises at time $t_{a0}$ and falls at time $t_{a1}$. The aggregator circuit 1304 further receives a second input pulse from a second input line that rises at time $t_{b0}$ and falls at time $t_{b1}$, where $t_{b0}$ is after $t_{a0}$ and before $t_{a1}$, and $t_{b1}$ is after $t_{a1}$. The aggregator circuit 1304 also receives a third input pulse from a third input line that rises at time $t_{c0}$ and falls at time $t_{c1}$, where $t_{c0}$ is after $t_{b0}$ and before $t_{b1}$, and $t_{c1}$ is after $t_{b1}$. The aggregator circuit 1304 outputs the combined power signal, which is high whenever any of the first pulse, the second pulse, or the third pulse is high. In the example shown in FIG. 14, the combined power signal rises at time $t_{a0}$ and falls at time $t_{c1}$.

Figure 15:
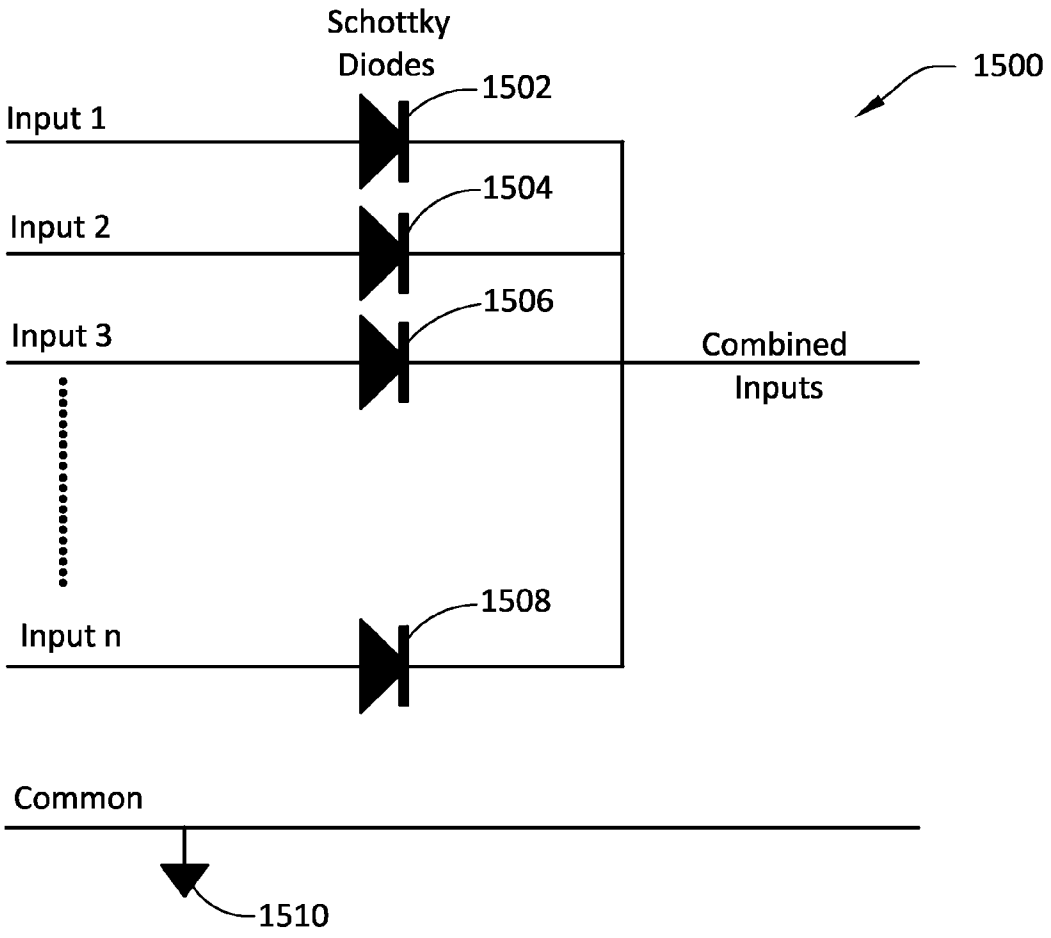
FIG. 15 is a schematic diagram of the exemplary aggregator circuit.

Now referring to FIG. 15, an exemplary implementation of the aggregator circuit 1304 is illustrated. In the exemplary implementation shown, the aggregator circuit 1304 comprises a plurality of Schottky diodes 1502-1508 that are arranged electrically in parallel and coupled to the respective input lines. The diodes 1502-1508 are coupled to a common ground 1510.

Figure 16:
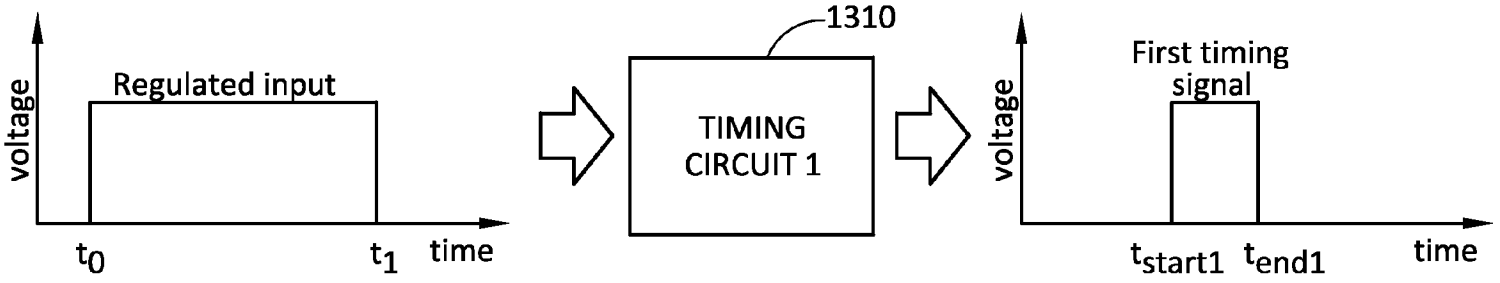
FIG. 16 illustrates operation of an exemplary timing circuit included in the exemplary control circuit.

With reference to FIG. 16, exemplary operation of the first timing circuit 1310 is depicted (the second timing circuit 1312 operates similarly). The first timing circuit 1310 is shown as receiving a regulated signal output by the regulator circuit 1304, which can indicate that the electromechanical latch 100 is desirably transitioned from the closed position to the open position. Responsive to receiving such regulated signal, the first timing circuit 1310 can output the first timing signal that rises at the first start time ($t_{start1}$) and falls at the first end time ($t_{end1}$), wherein the first actuator 102 is desired to drive the first rotary latch part 104 between the first start time and the first end time.

Figure 17:
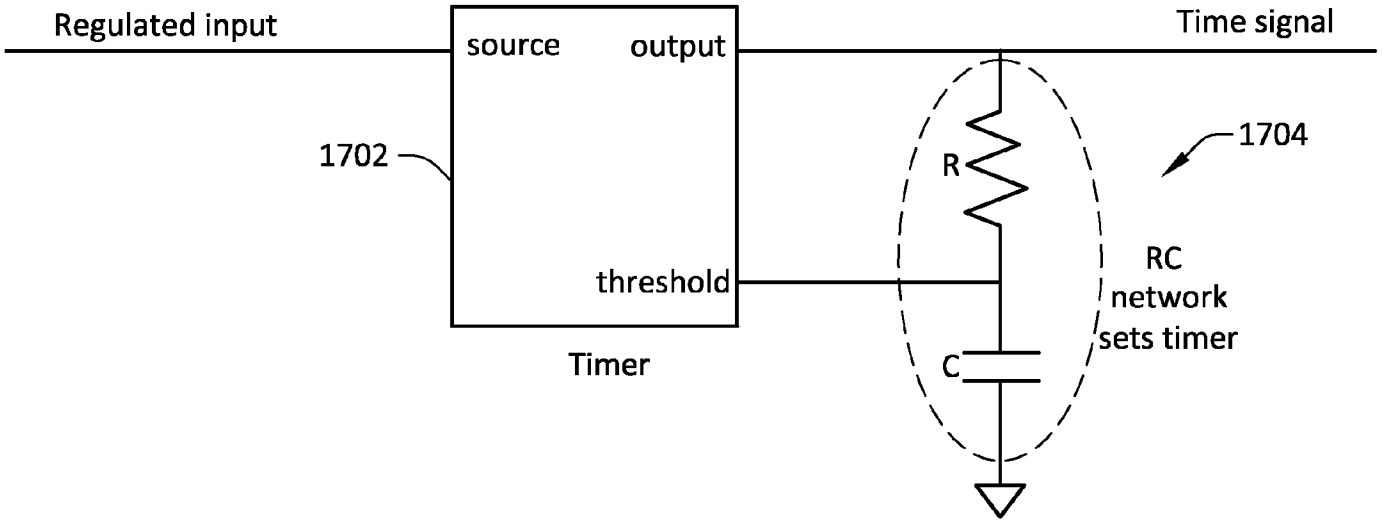
FIG. 17 is a schematic diagram of the exemplary timing circuit.

Referring to FIG. 17, an exemplary implementation 1700 of the first timing circuit 1310 (and the second timing circuit 1312) is illustrated. The first timing circuit 1310 includes a relatively standard timer 1702, which has an output terminal and a threshold terminal that are coupled to an RC network 1704. The RC network 1704 is used to set the timer, such the output of the first timing circuit 1310 is the first timing signal.

Figure 18:
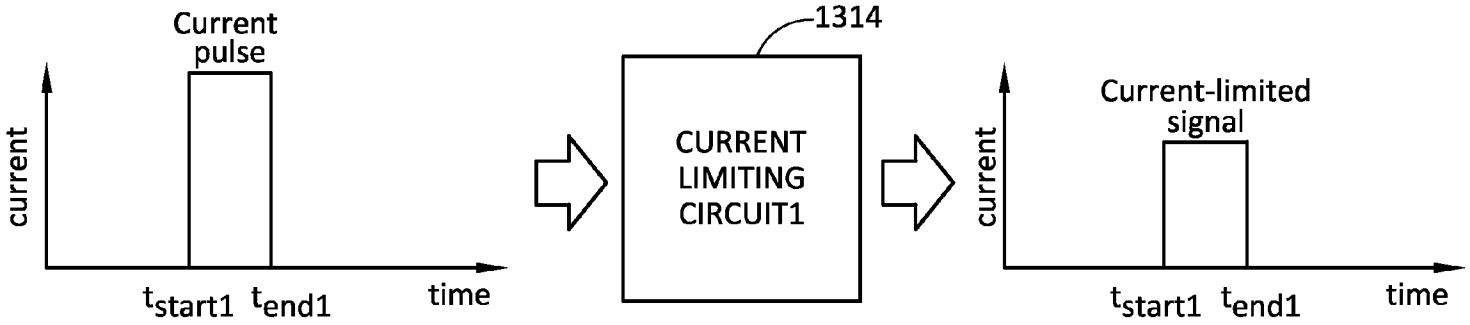
FIG. 18 illustrates operation of an exemplary current limiting circuit included in the exemplary control circuit.

With reference to FIG. 18, a diagram 1800 depicting exemplary operation of the first current limiting circuit 1314 is illustrated. The first current limiting circuit 1314 receives a current pulse from the first switch 1310, wherein the current pulse rises at the first start time and falls at the first end time. The first current limiting circuit 1314 is configured to limit the current provided to the first actuator 102. Accordingly, the first current limiting circuit 1314 outputs a first current-limited signal, which is received by the first actuator 102. Thus, the first actuator 102 drives the first rotary latch part 104 between the first start time and the first end time.

Figure 19:
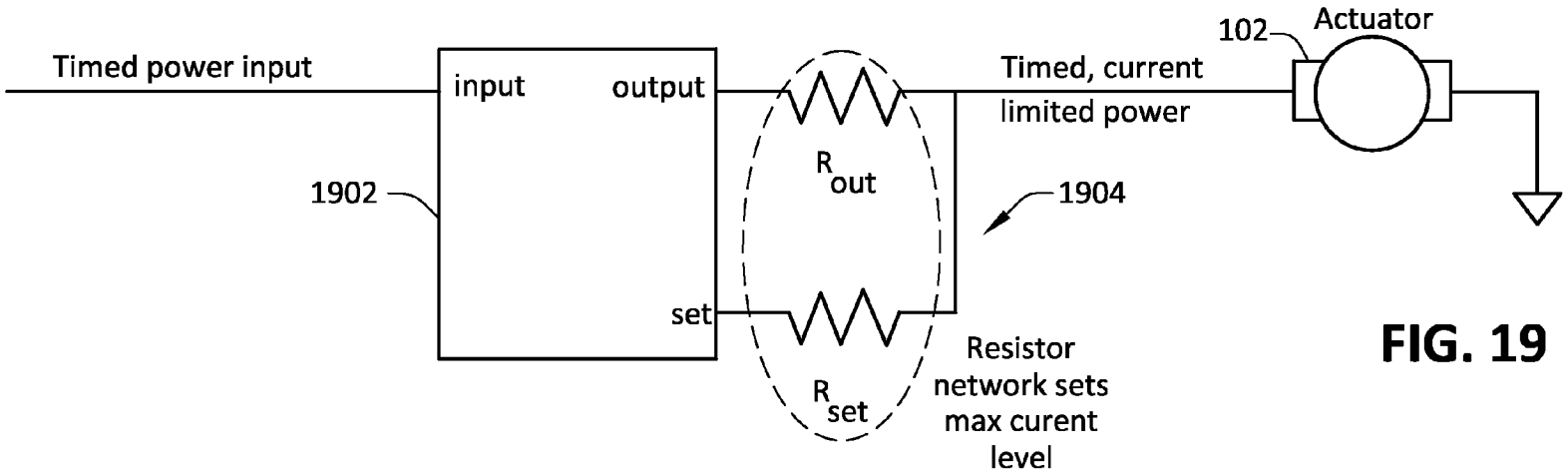
FIG. 19 is a schematic diagram of the exemplary current limiting circuit.

Now referring to FIG. 19, an exemplary implementation of the first current limiting circuit 1314 is illustrated. The first current limiting circuit 1314 can include a programmable current source 1902, the programmable current source 1902 comprising a set terminal and an output terminal. A resistor network 1904 sets a maximum current level that can be provided to the first actuator 102.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. An electromechanical latch that transitions from a closed position to an open position and from the open position to the closed position, the electromechanical latch comprising:

a first actuator;

a first rotary latch part that is driven by the first actuator, the first rotary latch part comprising a peg that extends therefrom;

a second actuator; and a second rotary latch part that is driven by the second actuator, the second rotary latch part having a proximal side and a distal side, the proximal side of the second rotary latch part comprising:

a raised cam that comprises a closed detent and an open detent, wherein when the electromechanical latch is in the closed position, the peg of the first rotary latch part is positioned in the closed detent of the raised cam and prevents rotation of the second rotary latch part in a first direction;

the distal side of the second rotary latch part comprising:

an output stage that engages a latch bar when the electromechanical latch is in the open position and disengages the latch bar when the electromechanical latch is in the closed position, wherein responsive to receipt of a control signal, the first motor is caused to drive the first rotary latch part such that the peg is removed from the closed detent, and subsequent to the peg being removed from the closed detent, the second motor is caused to drive the second rotary latch part in the first direction to position the peg against the open detent, the electromechanical latch being in the open position when the peg is positioned against the open detent.

2. The electromechanical latch of claim 1, further comprising:

a first spring coupled to the first rotary latch part and a first stationary peg, the first spring configured to exert a bias torque that opposes rotation of the first rotary latch part when driven by the first actuator.

3. The electromechanical latch of claim 2, the first spring being a coiled torsion spring.

4. The electromechanical latch of claim 2, wherein the second rotary latch part comprises a peg that extends from the proximal side of the second rotary latch part, the electromechanical latch further comprising:

a second spring that is coupled to the peg of the second rotary latch part and a second stationary peg, the second spring configured exert a bias torque that opposes rotation of the second rotary latch part in the first direction.

5. The electromechanical latch of claim 4, wherein the second spring is a coiled torsion spring.

6. The electromechanical latch of claim 1, the second rotary latch part being circular and having a teethed exterior.

7. The electromechanical latch of claim 6, further comprising a drive pinion, the drive pinion driven by the second actuator, wherein the drive pinion comprises teeth that mate with the teethed exterior of the second rotary latch part.

8. The electromechanical latch of claim 1, further comprising a control circuit that controls timing of power signals that drive the first actuator and the second actuator, respectively.

9. The electromechanical latch of claim 8, the control circuit comprising an aggregator circuit that receives a plurality of control signals, the control circuit aggregating energy in the control signals to provide the power signals to the first actuator and the second actuator, respectively.

10. The electromechanical latch of claim 9, further comprising:

a regulator circuit that is configured to receive a combined power signal output by the aggregator circuit and is further configured to output a regulated voltage signal based upon the combined power signal; and a timing circuit that is powered based upon the regulated voltage signal output by the regulator circuit.

11. The electromechanical latch of claim 1 configured to transition from the open position to the closed position without either the first actuator or the second actuator driving the first rotary latch part or the second rotary latch part, respectively.

12. The electromechanical latch of claim 11 configured to transition from the open position to the closed position responsive to receipt of an external force in a second direction that is opposite the first direction.

13. An electromechanical latch, comprising:

a first timing circuit that receives an indication that a control signal has been received, the first timing circuit configured to output a first timing pulse responsive to receiving the indication, the first timing pulse rising at a first start time and falling at a first end time;

a second timing circuit that receives the indication that the control signal has been received, the second timing circuit configured to output a second timing pulse responsive to receiving the indication, the second timing pulse rising at a second start time and falling at a second end time, the second start time subsequent to the first start time and prior to the first end time, the second end time being subsequent to the first end time;

a first motor that drives a first rotary latch part responsive to the first timing circuit outputting the first timing signal, the first rotary latch part positioned to prevent rotation of a second rotary latch part in a first direction prior to the first motor driving the first rotary latch part, the first motor driving the first rotary latch part such that the second rotary latch part is rotatable in the first direction; and a second motor that drives the second rotary latch part responsive to the second timing circuit outputting the second timing signal, the second motor causing the second rotary latch part to rotate in the first direction a threshold distance, wherein the electromechanical latch is in an open position only after the second rotary latch is rotated in the first direction the threshold distance.

14. The electromechanical latch of claim 13, further comprising a first spring that is coupled to a first stationary peg and the first rotary latch part, the first motor driving the first rotary latch part in a direction that is opposite of a direction of a first bias torque exerted on the first rotary latch part by the first spring.

15. The electromechanical latch of claim 14, further comprising a second spring that is coupled to a second stationary peg and the second rotary latch part, the second motor driving the second rotary latch part in a direction that is opposite of a direction of a second bias torque exerted on the second rotary latch part by the second spring.

16. The electromechanical latch of claim 13, further comprising an aggregator circuit that receives a plurality of control pulses and outputs a combined power signal based upon the control pulses, the first motor and the second motor powered based upon the combined power signal.

17. The electromechanical latch of claim 16, further comprising:

a first switch that receives the first timing signal output by the first timing circuit and the combined power signal output by the aggregator circuit, the first switch configured to output a first timed power signal based upon the first timing signal; and a second switch that receives the second timing signal output by the second timing circuit and the combined power signal output by the aggregator circuit, the second switch configured to output a second timed power signal based upon the second timing signal.

18. The electromechanical latch of claim 17, further comprising:

a first current limiting circuit that receives the first timed power signal output by the first switch, the first current limiting circuit configured to output a first current-limited signal based upon the first timed power signal, wherein the first timed power signal drives the first motor; and a second current limiting circuit that receives the second timed power signal output by the second switch, the second current limiting circuit configured to output a second current-limited signal based upon the second timed power signal, wherein the second timed power signal drives the second motor.

19. The electromechanical latch of claim 13, further comprising an engagement mechanism that engages with a latch bar only when the electromechanical latch is in the open position.

* * * * *